US009640927B1

(12) United States Patent
Kay et al.

(10) Patent No.: US 9,640,927 B1
(45) Date of Patent: May 2, 2017

(54) JUMPER ASSEMBLY

(71) Applicant: Western Digital Technologies, Inc., Irvine, CA (US)

(72) Inventors: Joshua E. Kay, Santa Cruz, CA (US); Amy L. Pham, Tustin, CA (US); Christopher H. Aiello, Irvine, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 0 days.

(21) Appl. No.: 14/946,007

(22) Filed: Nov. 19, 2015

(51) Int. Cl.
*H01R 31/08* (2006.01)

(52) U.S. Cl.
CPC ..... *H01R 31/08* (2013.01)

(58) Field of Classification Search
CPC ..... H01R 31/08
USPC ..... 439/207, 509–512
See application file for complete search history.

(56) References Cited

U.S. PATENT DOCUMENTS 5,041,015 A * 8/1991 Travis ..... H01R 43/205 439/492
7,938,677 B1 5/2011 Zhu
8,602,813 B1 12/2013 Pan et al.

* cited by examiner

*Primary Examiner* — Javaid Nasri

(57) ABSTRACT

A jumper assembly includes a first pin with a first surface discontinuity, and a jumper shunt for providing an electrical connection between the first pin and a second pin. The jumper shunt includes a clip configured to catch on the first surface discontinuity to keep the jumper shunt in contact with the first pin. Another jumper assembly includes a first pin and a blocking portion on the first pin. A jumper shunt is configured to move along the first pin with the blocking portion limiting motion of the jumper shunt along the first pin beyond the blocking portion.

27 Claims, 6 Drawing Sheets

JUMPER ASSEMBLY

BACKGROUND

Jumper shunts can be used on circuit boards to provide a way of selecting different configurations or settings by contacting different pins on a circuit board when a jumper shunt is placed over the pins. The jumper shunt can include a short length of conductor housed within a non-conductive enclosure. When the jumper shunt is placed over pins, an electrical connection is formed between the pins, and circuitry can activate different settings based on the electrical connection. Similarly, a setting can be changed by removing the jumper shunt or connecting the jumper shunt to a different pin.

Jumper shunts can become easily lost when removed from the pins, in part due to their typically small size. In some cases, the jumper shunts may inadvertently lose contact with pins or become lost when a circuit board is moved or vibrated. Jumper shunts may also cause damage to components if connected to the wrong pins.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1B:
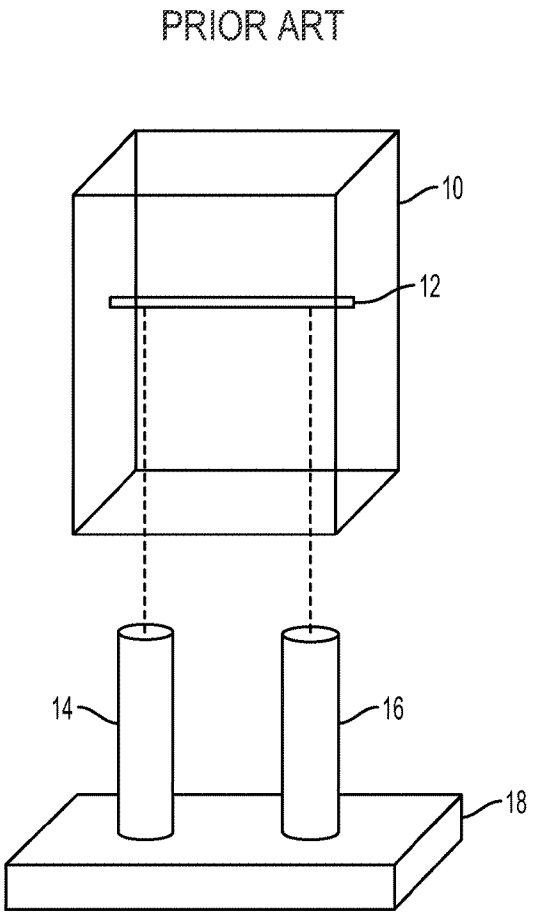
FIG. 1B depicts an example of the conventional jumper shunt of FIG. 1A when the jumper shunt is removed from the pins.
Figure 1A:
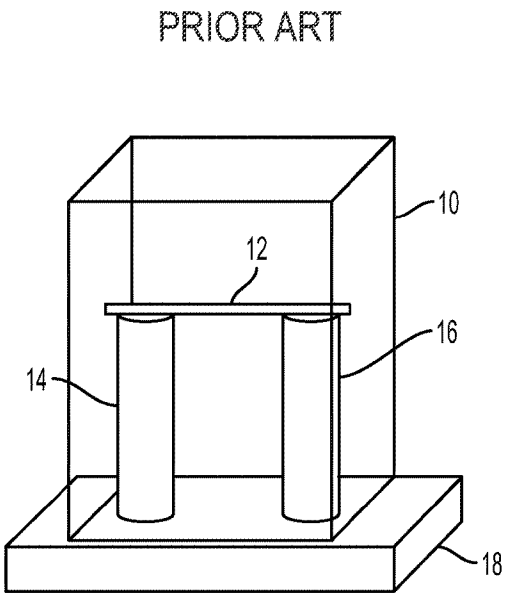
FIG. 1A depicts an example of a conventional jumper shunt when the jumper shunt is in contact with pins.

FIG. 1A depicts an example of conventional jumper shunt 10 placed over pins 14 and 16. As shown in FIG. 1A, pins 14 and 16 are mounted on circuit board 18, which can include other circuitry in addition to pins 14 and 16. Circuit board 18 can form part of an electronic device such as a Data Storage Device (DSD), Digital Video Recorder (DVR), or a computer system.

Jumper shunt 10 includes conductor 12, which can include a short length of conductor inside an exterior housing of jumper shunt 10. When jumper shunt 10 is placed over pins 14 and 16, conductor 12 forms an electrical connection between pins 14 and 16. The closing or opening of the circuit between pins 14 and 16 configures the circuitry of circuit board 18 with different settings.

When jumper shunt 10 is removed as shown in FIG. 1B, conductor 12 no longer contacts pins 14 and 16 and the circuit between pins 14 and 16 opens. As noted above, jumper shunts can become easily lost when removed from pins, which can result in inconvenience and require a replacement jumper. In some cases, conductor 12 may unintentionally lose contact with pin 14 or 16 when circuit board 18 or the electronic device is moved or vibrated. Jumper shunt 10 may also cause damage to components if connected to the wrong pins.

Figure 2B:
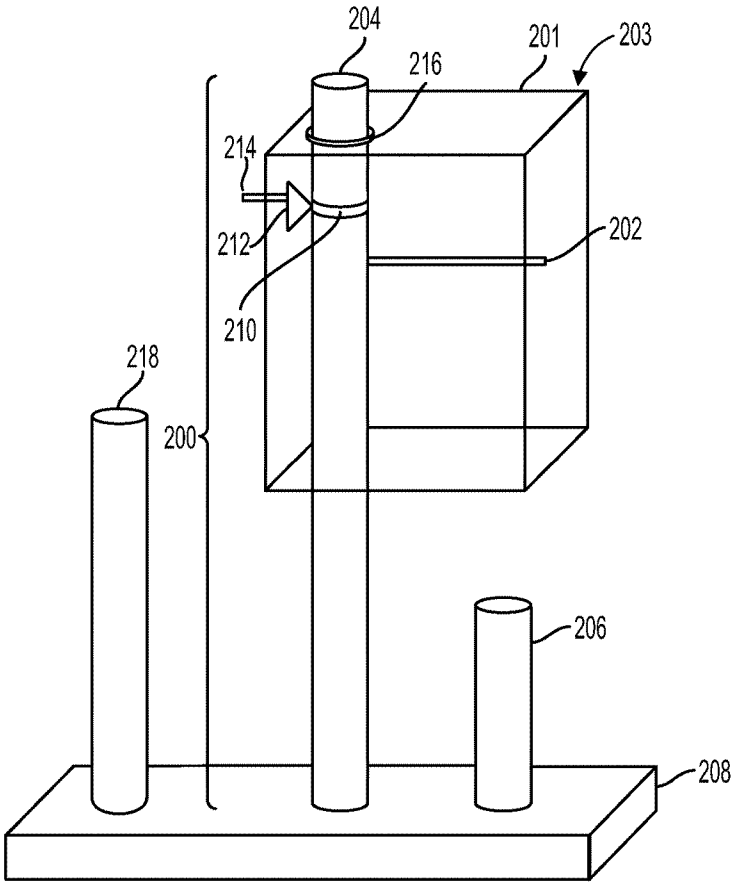
FIG. 2B depicts the jumper assembly of FIG. 2A in a non-contacting position according to an embodiment.
Figure 2A:
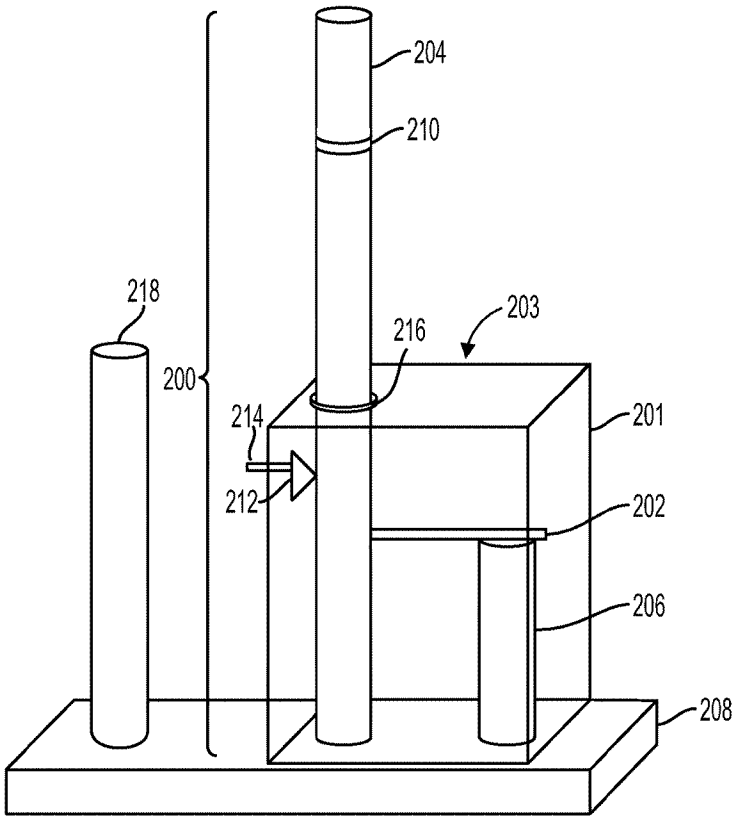
FIG. 2A depicts an example of a jumper assembly according to an embodiment where a pin includes a surface discontinuity.

FIG. 2A depicts an example of a jumper assembly according to an embodiment where a pin of the jumper assembly includes a surface discontinuity. As shown in FIG. 2A, jumper assembly 200 includes pin 204 and jumper shunt 203. Pin 204 includes surface discontinuity 210 to keep jumper shunt 203 in contact with pin 204. By keeping jumper shunt 203 in contact with pin 204, it is ordinarily possible to reduce the likelihood that jumper shunt 203 becomes lost or incorrectly positioned on the wrong pin, or accidentally disconnected from one of the pins.

Pins 218, 204, and 206 are mounted on circuit board 208, which can include other circuitry in addition to the pins shown in FIGS. 2A and 2B. Circuit board 208 can form part of an electronic device such as a DSD, DVR, or a computer system. In some implementations, circuit board 208 may form part of a development kit or Single Board Computer (SBC) such as a Raspberry Pi module, Intel Edison module, Intel Galileo module, or an Arduino module.

Jumper shunt 203 includes conductor 202 which electrically connects pins 204 and 206. Jumper shunt 203 also includes housing 201, which can be made out of an insulating material such as plastic. Clip 212 is configured inside housing 201 to catch on surface discontinuity 210 to prevent removal of jumper shunt 203 from pin 204. Although clip 212 is shown in FIGS. 2A and 2B as having a triangular shape, clip 212 can have a different shape or design for mating with surface discontinuity 210.

Surface discontinuity 210 can include an indentation, groove, or protrusion on pin 204. Although FIGS. 2A and 2B show surface discontinuity 210 as having an annular shape, surface discontinuity 210 may have a different shape in other embodiments. In addition, surface discontinuity 210 may not completely surround pin 204 in other embodiments. For example, surface discontinuity 210 may include a notch, hole, or tab on pin 204. In some embodiments, pin 206 may include a surface discontinuity instead of, or in addition to, surface discontinuity 210 on pin 204.

Release portion 214 is configured to release clip 212 from surface discontinuity 210 when pressed to allow jumper shunt 203 to move beyond surface discontinuity 210. In some implementations, clip 212 holds jumper shunt 203 in one position above pin 206, as shown in FIG. 2B. Pressing release portion 214 can allow for jumper shunt 203 to be moved back down along pin 204 by releasing clip 212 from surface discontinuity 210.

Other embodiments may not include release portion 214. In certain embodiments, clip 212 may not be allowed to move past surface discontinuity 210. In yet other embodiments without release portion 214, clip 212 can be flexible enough to allow clip 212 to release from surface discontinuity 210 when pulled with more than a threshold amount of force. In this regard, clip 212 can be made of different materials, thicknesses, or mate with surface discontinuity 210 so that clip 212 can be released. Although jumper shunt 203 can be removable from pin 204 in some embodiments, clip 212 and surface discontinuity 210 can provide enough resistance so that jumper shunt 203 is not accidentally lost or removed from pin 204.

FIG. 2B depicts jumper shunt 203 in a non-contacting position above pin 206 according to an embodiment. As noted above, jumper shunt 203 can be retained in this position in some implementations. After pressing release portion 214, jumper shunt 203 can be moved along pin 204 with pin 204 protruding through hole 216 of housing 201.

Jumper shunt 203 is rotatable about pin 204 when jumper shunt 203 is moved beyond a length of pin 206. In some implementations, jumper shunt 203 is configured to provide an electrical connection between pin 204 and either pin 206 or another pin (not shown) based on the rotational position of jumper shunt 203 about pin 204.

As shown in FIGS. 2A and 2B, surface discontinuity 210 is positioned on pin 204 so as to prevent jumper shunt 203 from being rotated over pin 218, which is longer than pin 206 but shorter than pin 204. This arrangement can help prevent jumper shunt 203 from being used to make an improper electrical connection that may have no effect in changing settings or might damage components. In other embodiments, the width of jumper shunt 203 can be designed to limit which pins can be used with jumper shunt 203 to connect to pin 204 based on a distance from pin 204.

In other embodiments, jumper shunt 203 can have a different shape that allows jumper shunt 203 to connect more than two pins. For example, in some embodiments, jumper shunt 203 can have an "L" shape, a longer rectangular shape, or a square shape when viewed from above to accommodate more than two pins.

Figure 3:
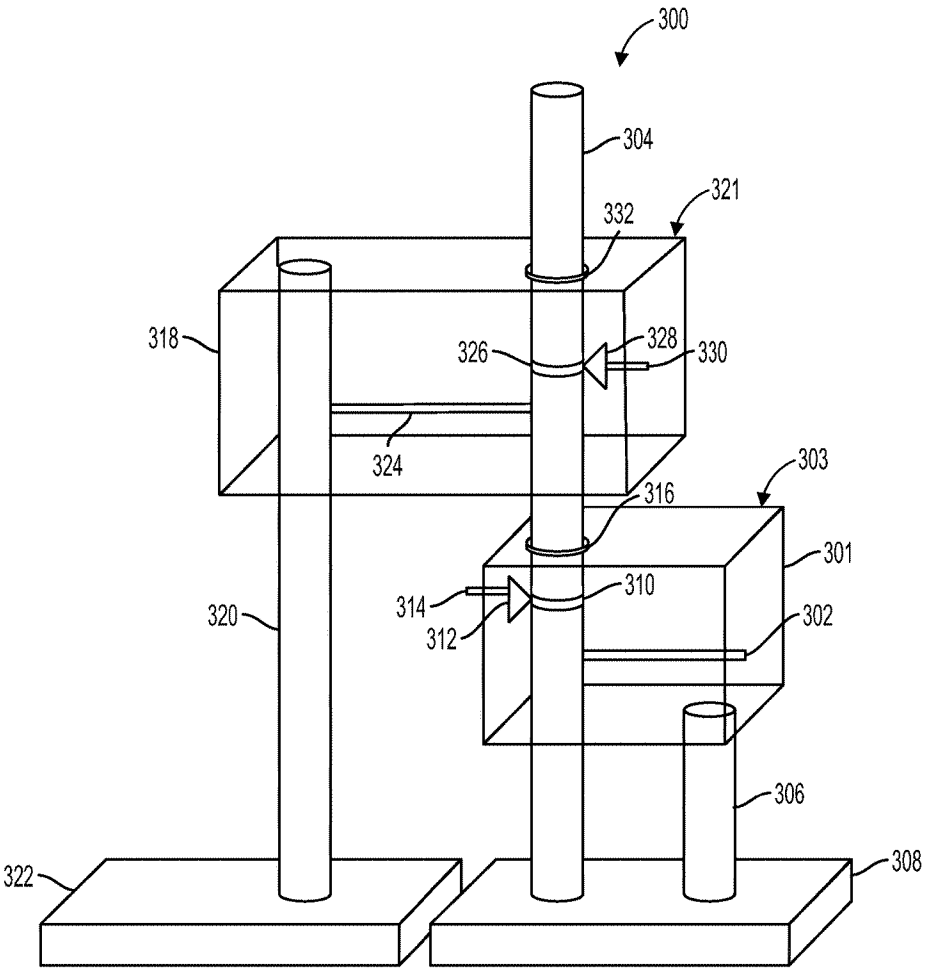
FIG. 3 depicts an example of a jumper assembly including two jumper shunts for contacting pins on different circuit boards according to an embodiment.

FIG. 3 shows an example of a jumper assembly including two jumper shunts for contacting pins on different circuit boards according to an embodiment. As shown in FIG. 3, jumper assembly 300 includes pin 304, jumper shunt 303, and jumper shunt 321.

Pin 320 is mounted on circuit board 322, and pins 304 and 306 are mounted on circuit board 308. Each of circuit boards 322 and 308 can include other circuitry in addition to the pins shown in FIG. 3. The circuit boards can form part of an electronic device. In some implementations, the circuit boards may form part of a development kit or SBC.

Conductor 302 of jumper shunt 303 is arranged to connect pins 304 and 306, but jumper shunt 303 is retained in a position above pin 306 as shown in FIG. 3 so that conductor 302 only contacts pin 304 and not pin 306. Jumper shunt 303 is retained in this position by clip 312 which is caught or locked on surface discontinuity 310 on pin 304.

Surface discontinuity 310 can include an indentation, groove, or protrusion on pin 304 that mates with clip 312 to hold jumper shunt 303 in place and prevents jumper shunt 303 from moving past surface discontinuity 310. In other embodiments, pins 320 or 306 may include a surface discontinuity instead of, or in addition to, surface discontinuities 326 or 310 on pin 304.

Although FIG. 3 shows surface discontinuities 310 and 326 as having an annular shape, surface discontinuities 310 or 326 may have a different shape in other embodiments. In addition, surface discontinuities 310 or 326 may not completely surround pin 304 in other embodiments. For example, surface discontinuities 310 or 326 may include a notch, hole, or tab on pin 304.

When jumper shunt 303 is moved along pin 304 above pin 306, jumper shunt 303 can be rotated about pin 304. In some implementations, jumper shunt 303 can be configured to provide an electrical connection between pin 304 and either pin 306 or another pin not shown in FIG. 3 based on the rotational position of jumper shunt 303.

Jumper shunt 303 also includes release portion 314 that is accessible from outside of housing 301 to allow for the release of clip 312 from surface discontinuity 310 with the application of more than a threshold amount of force. When released, jumper shunt 303 can be slid along pin 304 through hole 316 in housing 301. In addition, jumper shunt 321 can be moved along pin 304 between surface discontinuity 310 and surface discontinuity 326.

In some embodiments, release portion 330 and/or release portion 314 can be omitted. In such embodiments, jumper shunt 303 and/or jumper shunt 321 may not be moved past surface discontinuity 310 and/or surface discontinuity 326, respectively, or may be moved past a surface discontinuity with a threshold amount of force. Clip 312 and/or clip 328 can be configured to allow release from a surface discontinuity when pulled with sufficient force. In this regard, the flexibility, thickness, or materials used for the clips can allow the clips to be released with enough force applied to the jumper shunts. Although clips 312 and 328 are shown in FIG. 3 as having a triangular shape, clips 312 or 328 can have a different shape or design for mating with surface discontinuities 310 or 326.

Jumper shunt 321 is arranged to provide an electrical connection between pins 304 and 320 using conductor 324. As shown in FIG. 3, jumper shunt 321 is retained or locked into a position above jumper shunt 303, with clip 328 mated with surface discontinuity 326 on pin 304. In the example shown in FIG. 3, jumper shunt 321 can be unlocked from surface discontinuity 326 by pressing release portion 330, which extends outside of housing 318. In other embodiments, release portion 330 may be omitted and jumper shunt 321 may either be locked in place or allowed to move between jumper shunt 303 and surface discontinuity 326 with pin 304 sliding through hole 332.

In the example of FIG. 3, pins 306 and 320 are on two different circuit boards with pin 306 located on circuit board 308, and pin 320 located on circuit board 322. Jumper shunt 321 can provide additional stability or reinforcement between the two circuit boards with clip 328 locked into surface discontinuity 326. This stability can help prevent unwanted movement of the circuit boards relative to each other, or help prevent unwanted movement of components of the circuit boards due to a mechanical shock or vibration.

Jumper assembly 300 can be arranged so that conductor 302 of jumper shunt 303 provides an electrical connection between pins 304 and 306 with clip 312 positioned below surface discontinuity 310. In addition, jumper shunt 321 can be removed from pin 320 with sufficient force applied to release portion 330 to release clip 328 from surface discontinuity 326.

In other embodiments, one or both of jumper shunts 303 and 321 can have a different shape that allows jumper shunt 303 or 321 to connect more than two pins. For example, in some embodiments, jumper shunt 303 or 321 can have an "L" shape, a longer rectangular shape, or a square shape when viewed from above to accommodate more than two pins.

Figure 4:
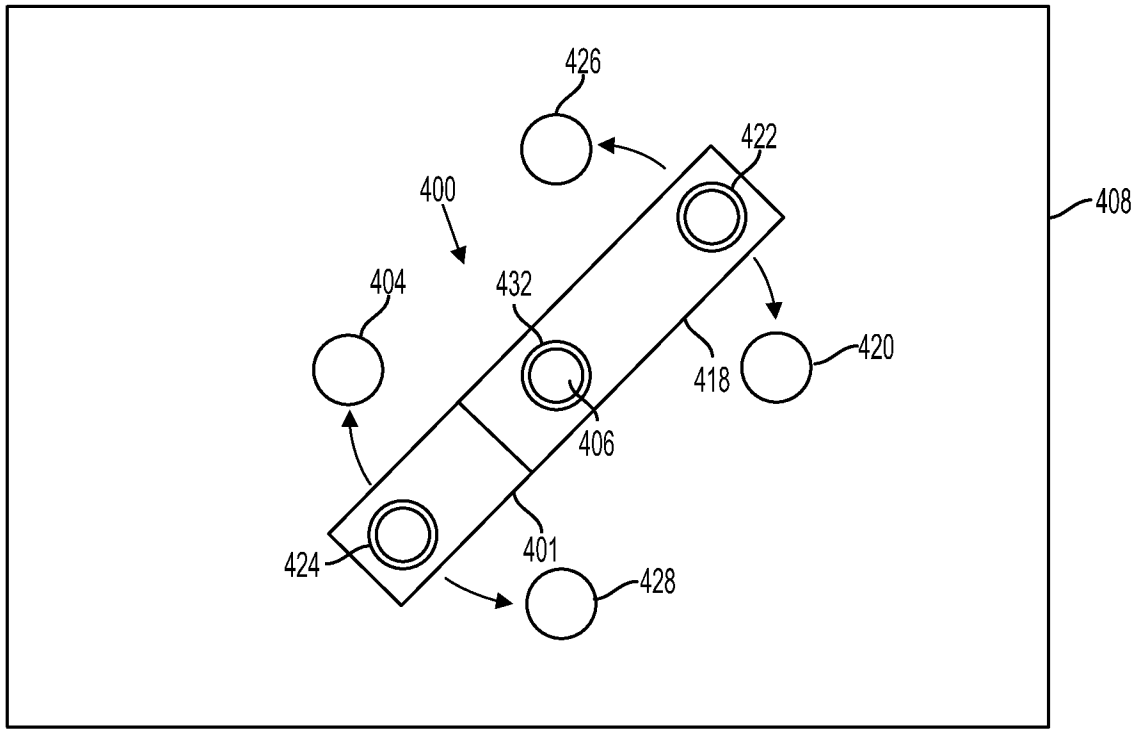
FIG. 4 is a top view of an example jumper assembly with jumper shunts that can rotate about a pin according to an embodiment.

FIG. 4 is a top view of an example jumper assembly with jumper shunts that can rotate about a pin according to an embodiment. As shown in FIG. 4, jumper assembly 400 includes pin 406, jumper shunt 401, and jumper shunt 418 above jumper shunt 401. Pins 406, 404, 428, 426, and 420 are mounted on circuit board 408. Both jumper shunt 401 and jumper shunt 418 are shown in FIG. 4 as being in contact with pin 406, with pin 406 protruding through a hole (not shown) in jumper shunt 401 and through hole 432 of jumper shunt 418.

Circuit board 408 can include other circuitry in addition to the pins shown in FIG. 4. In this regard, circuit board 408 can form part of an electronic device or may form part of a development kit or SBC.

Jumper shunt 401 can be rotated about pin 406 to provide an electrical connection with either pin 404 or pin 428 by placing hole 424 over either pin. Pin 406 can be longer than pins 404 and 428 so that jumper shunt 401 can be moved from pin 404 to pin 428, or vice-versa, without removing jumper shunt 401 from pin 406. A surface discontinuity on each of pin 404 and pin 428, such as surface discontinuities 210, 310, or 326 discussed above, can provide resistance from removing jumper shunt 401 from either pin.

Jumper shunt 418 can also be rotated about pin 406 to provide an electrical connection with either pin 420 or pin 426 by placing hole 422 over either pin. Pin 406 can be longer than pins 420 and 426 so that jumper shunt 418 can be moved from pin 420 to pin 426, or vice-versa, without removing jumper shunt 418 from pin 406. A surface discontinuity on each of pin 420 and pin 426 can provide resistance from removing jumper shunt 418 from either pin.

In some implementations, the height of one or more of pins 426, 420, 404, and 428 can restrict the rotation of jumper shunt 401 and/or jumper shunt 418 about pin 406. The height of the pins can therefore be used to ensure that a particular jumper shunt can only form a connection with certain pins that are at a height below a surface discontinuity that limits the vertical motion of the jumper shunt.

In the example of FIG. 4, the height of pins 420 and 426 can be taller than a surface discontinuity on pin 406 that limits the movement of jumper shunt 401 to a higher position on pin 406. As a result, hole 424 of jumper shunt 401 is prevented from being placed over either of pins 420 or 426 so that only shorter pins 404 and 428 can be connected by jumper shunt 401.

Figure 5:
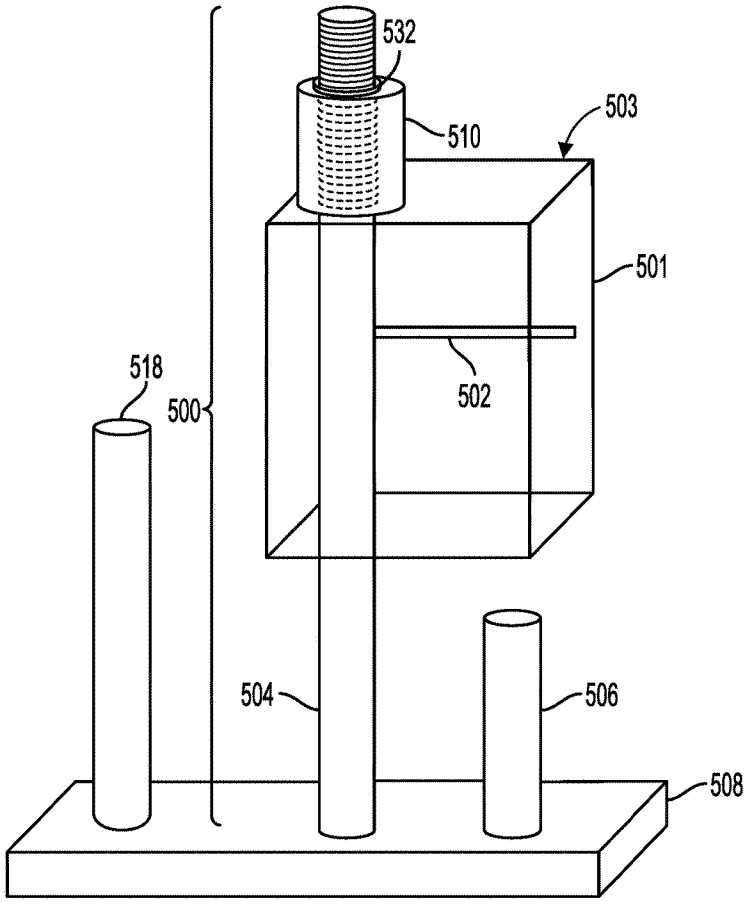
FIG. 5 is an example of a jumper assembly that includes a blocking portion on a pin according to an embodiment.

FIG. 5 is an example of a jumper assembly that includes a blocking portion on a pin according to an embodiment. As shown in FIG. 5, jumper assembly 500 includes jumper shunt 503, blocking portion 510, and pin 504. Blocking portion 510 is positioned on pin 504 to limit motion of jumper shunt 503 beyond blocking portion 510.

Pins 504, 506, and 518 are mounted on circuit board 508, which can include other circuitry in addition to the pins shown in FIG. 5. Circuit board 508 can form part of an electronic device, development kit, or SBC.

In the example of FIG. 5, blocking portion 510 is removable from pin 504. Blocking portion 510 can be frictionally secured to pin 504 about hole 532. In some implementations, blocking portion 510 can be moved along pin 504 by using more than a threshold amount of force to slide blocking portion 510 along pin 504. In other implementations, blocking portion 510 can be more permanently affixed to pin 504 using, for example, glue. In yet other implementations, blocking portion 504 can be integrally formed as part of pin 504.

In one implementation, blocking portion 510 can be screwed onto pin 504. In such an implementation, a top portion of pin 504 can be threaded and an internal surface of blocking portion 510 inside hole 532 can include threads to screw blocking portion 510 onto pin 504.

Pin 504 is longer than pin 506, and blocking portion 510 is located on pin 504 such that jumper shunt 503 can be disconnected from pin 506 while remaining in contact with pin 504, as shown in FIG. 5. When jumper shunt 503 is lowered over pin 506, conductor 502 of jumper shunt 503 provides an electrical connection between pins 504 and 506 to complete a circuit.

When jumper shunt 503 is moved along pin 504 beyond a length of pin 506, as shown in FIG. 5, jumper shunt 503 is rotatable about pin 504. In some implementations, jumper shunt 503 is configured to provide an electrical connection between pin 504 and either pin 506 or another pin not shown based on a rotational position of jumper shunt 503 about pin 504.

As shown in FIG. 5, blocking portion 510 is positioned on pin 504 so as to prevent jumper shunt 503 from being rotated over pin 518, which is longer than pin 506, but shorter than pin 504. This arrangement can help prevent jumper shunt 503 from being used to make an improper electrical connection with pin 518 that may have no effect in changing settings or might damage components. In this regard, conductor 502 is enclosed within housing 501, which is made of an insulating material to prevent an inadvertent electrical connection with conductor 502. In other embodiments, the width of jumper shunt 503 can be designed to limit which pins can be used with jumper shunt 203 to connect to pin 204 based on a distance from pin 204.

In other embodiments, jumper shunt 503 can have a different shape that allows jumper shunt 503 to connect more than two pins. For example, in some embodiments, jumper shunt 503 can have an "L" shape, a longer rectangular shape, or a square shape when viewed from above to accommodate more than two pins.

Figure 6:
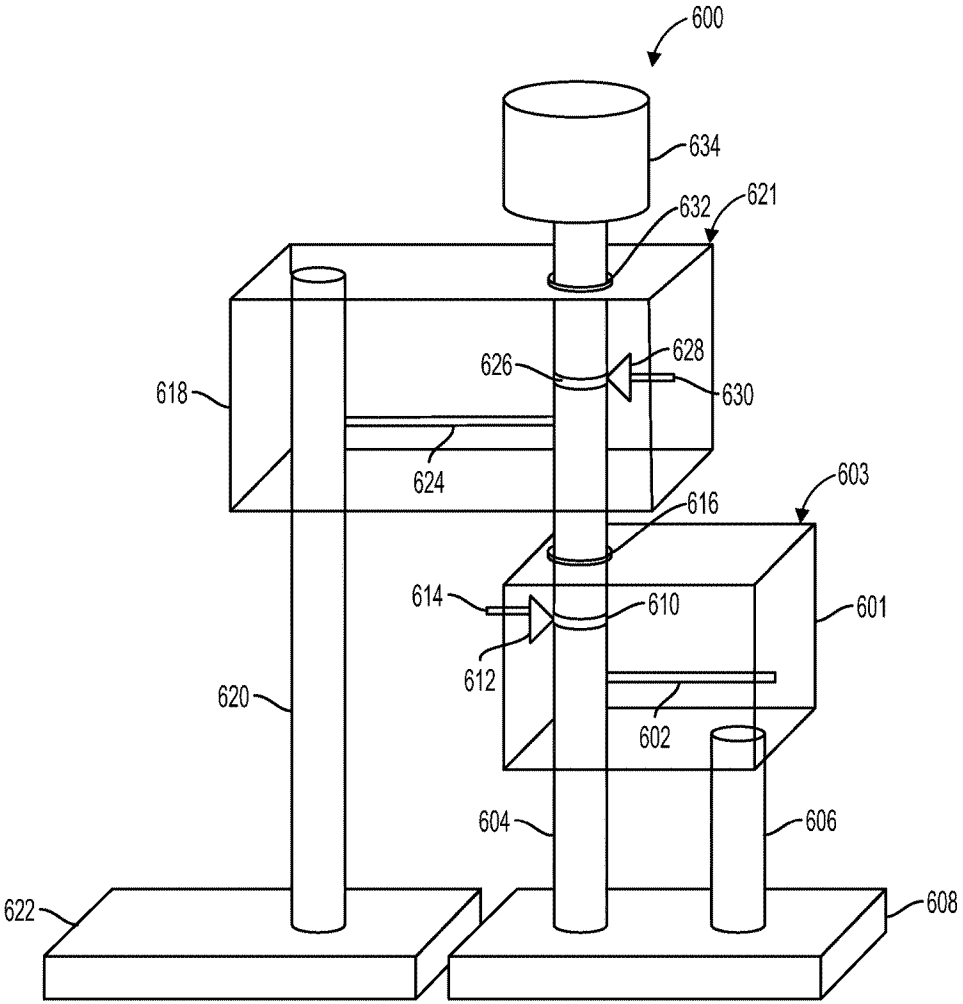
FIG. 6 is an example of a jumper assembly that includes a blocking portion on a pin and two jumper shunts for contacting pins on different circuit boards according to an embodiment.

FIG. 6 is an example of a jumper assembly that includes a blocking portion on a pin and two jumper shunts for contacting pins on different circuit boards according to an embodiment. As shown in FIG. 6, jumper assembly 600 includes jumper shunts 603 and 621, pin 604, and blocking portion 634.

Pin 620 is mounted on circuit board 622, and pins 604 and 606 are mounted on circuit board 608. Each of circuit boards 622 and 608 can include other circuitry in addition to the pins shown in FIG. 6. The circuit boards can form part of an electronic device, development kit, or SBC.

Conductor 602 of jumper shunt 603 is arranged to connect pins 604 and 606, but jumper shunt 603 is retained in a position above pin 606 as shown in FIG. 6 so that conductor 602 only contacts pin 604 and not pin 606. Jumper shunt 603 is retained in this position by clip 612 which is caught or locked on surface discontinuity 610 on pin 604. Surface discontinuity 610 can include an indentation on pin 604 or a protrusion from pin 604 that mates with clip 612 to hold jumper shunt 603 in place or to prevent jumper shunt 603 from moving past surface discontinuity 610. In other embodiments, pin 620 may include a surface discontinuity instead of, or in addition to, surface discontinuity 626 on pin 604.

When jumper shunt 603 is moved along pin 604 above pin 606, jumper shunt 603 can be rotated about pin 604. In some implementations, jumper shunt 603 can be configured to provide an electrical connection between pin 604 and either pin 606 or another pin not shown based on the rotational position of jumper shunt 603.

Jumper shunt 603 also includes release portion 614 that is accessible from outside of housing 601 to allow for the release of clip 612 from surface discontinuity 610 with the application of more than a threshold amount of force. When released, jumper shunt 603 can be slid along pin 604 through hole 616 in housing 601. In addition, jumper shunt 621 can be moved along pin 604 between surface discontinuity 610 and surface discontinuity 626. Although clips 612 and 628 are shown in FIG. 6 as having a triangular shape, clips 612 or 628 can have a different shape or design for mating with surface discontinuities 610 or 626.

In other embodiments, pins 620 or 606 may include a surface discontinuity instead of, or in addition to, surface discontinuities 626 or 610 on pin 604. Although FIG. 6 shows surface discontinuities 610 and 626 as having an annular shape, surface discontinuities 610 or 626 may have a different shape in other embodiments. In addition, surface discontinuities 610 or 626 may not completely surround pin 604 in other embodiments. In one example, surface discontinuities 610 or 626 may include a notch, hole, or tab on pin 604.

Although jumper shunts 603 and 621 can be released from surface discontinuities 610 and 626, respectively, both jumper shunts 603 and 601 may be retained on pin 604 by blocking portion 634. Blocking portion 634 can be frictionally secured to pin 604, screwed onto pin 604, or integrally formed as part of pin 604. For example, blocking portion 634 may be glued onto pin 604. In another example, blocking portion 634 may be threaded to mate with threads on a top portion of pin 604. In some implementations, blocking portion 634 is removable from pin 604.

In other embodiments, blocking portion 634 can include a cylindrical hole through its center to allow blocking portion 634 to be moved along pin 604 by using more than a threshold amount of force to slide blocking portion 634 along pin 604.

In some embodiments, release portion 630 and/or release portion 614 can be omitted. In such embodiments, jumper shunt 603 and/or jumper shunt 621 may not be moved past surface discontinuity 610 and/or surface discontinuity 626, respectively, or may be moved past a surface discontinuity with a threshold amount of force. Clip 612 and/or clip 628 can be configured to allow release from a surface discontinuity when pulled with sufficient force. In this regard, the flexibility, thickness or materials used for the clips can allow the clips to be released with enough force applied to the jumper shunts.

Jumper shunt 621 is arranged to provide an electrical connection between pins 604 and 620 using conductor 624. As shown in FIG. 6, jumper shunt 621 is retained or locked into its position above jumper shunt 603, with clip 628 mated with surface discontinuity 626 on pin 604. In the example shown in FIG. 6, jumper shunt 621 can be unlocked from surface discontinuity 626 by pressing release portion 630, which extends outside of housing 618. In other embodiments, release portion 630 may be omitted and jumper shunt 621 may either be locked in place or allowed to move between jumper shunt 603 and surface discontinuity 626 with pin 604 sliding through hole 632.

In the example of FIG. 6, pins 606 and 620 are on two different circuit boards with pin 606 located on circuit board 608, and pin 620 located on circuit board 622. Jumper shunt 621 can provide stability between the two circuit boards with clip 628 locked into surface discontinuity 626.

Jumper assembly 600 can be arranged so that conductor 602 of jumper shunt 603 provides an electrical connection between pins 604 and 606 with clip 612 positioned below surface discontinuity 610. In addition, in an implementation where blocking portion 634 can be removed from pin 604, jumper shunt 621 can be removed from pin 620 with sufficient force to release clip 628 from surface discontinuity 626 on pin 604.

In other embodiments, one or both of jumper shunts 603 and 621 can have a different shape that allows jumper shunt 603 or 621 to connect more than two pins. For example, in some embodiments, jumper shunt 603 or 621 can have an "L" shape, a longer rectangular shape, or a square shape when viewed from above to accommodate more than two pins.

As discussed above, it is ordinarily possible to reduce the likelihood of losing a jumper shunt or having the jumper shunt move to an unwanted position by providing one or more surface discontinuities on a pin or by providing a blocking portion on the pin.

OTHER EMBODIMENTS

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. The described embodiments are to be considered in all respects only as illustrative and not restrictive and the scope of the disclosure is, therefore, indicated by the following claims rather than by the foregoing description. All changes which come within the meaning and range of equivalency of the claims are to be embraced within their scope.

The invention claimed is:

1. A jumper assembly, comprising:

a first pin including a first surface discontinuity that includes an indentation or a protrusion on the first pin; and a jumper shunt for providing an electrical connection between the first pin and a second pin, wherein the jumper shunt includes a clip configured to mate with the first surface discontinuity to keep the jumper shunt in contact with the first pin.

2. The jumper assembly of claim 1, wherein the first pin further includes a second surface discontinuity spaced apart from the first surface discontinuity along the first pin, and wherein the jumper shunt is movable along the first pin between the first surface discontinuity and the second surface discontinuity.

3. The jumper assembly of claim 1, wherein the first pin is longer than the second pin and the first surface discontinuity is located on the first pin such that when the clip mates with the first surface discontinuity, the jumper shunt is not in contact with the second pin.

4. The jumper assembly of claim 1, wherein the first pin is longer than the second pin, and wherein the jumper shunt is configured to be rotatable about the first pin when the jumper shunt is moved along the first pin beyond a length of the second pin.

5. The jumper assembly of claim 4, wherein the jumper shunt is configured to provide an electrical connection between the first pin and either the second pin or a third pin based on a rotational position of the jumper shunt about the first pin.

6. The jumper assembly of claim 4, wherein the first surface discontinuity is positioned on the first pin so as to prevent the jumper shunt from being rotated over a third pin that is longer than the second pin but shorter than the first pin.

7. The jumper assembly of claim 1, wherein the jumper shunt includes a housing, and at least a portion of the clip is located inside the housing.

8. The jumper assembly of claim 1, wherein the jumper shunt further includes a housing, and a release portion outside the housing configured to release the clip from the first surface discontinuity when pressed.

9. The jumper assembly of claim 1, wherein the clip is configured to allow the clip to release from the first surface discontinuity when the jumper shunt is pulled with more than a threshold amount of force.

10. The jumper assembly of claim 1, wherein the first pin is located on a first circuit board and the second pin is located on a second circuit board.

11. The jumper assembly of claim 1, further comprising a second jumper shunt for providing an electrical connection between the first pin and a third pin.

12. A jumper assembly, comprising:

a first pin;

a blocking portion on the first pin, wherein the blocking portion is removable; and a jumper shunt for providing an electrical connection between the first pin and a second pin, wherein the jumper shunt is configured to move along the first pin with the blocking portion limiting motion of the jumper shunt along the first pin beyond the blocking portion.

13. The jumper assembly of claim 12, wherein the first pin is located on a first circuit board and the second pin is located on a second circuit board.

14. The jumper assembly of claim 12, further comprising a second jumper shunt for providing an electrical connection between the first pin and a third pin.

15. The jumper assembly of claim 12, wherein at least a portion of the first pin is threaded and the blocking portion includes an internal surface that is threaded so that the blocking portion can be screwed onto the first pin.

16. The jumper assembly of claim 12, wherein the blocking portion is frictionally secured to the first pin.

17. The jumper assembly of claim 16, wherein the blocking portion is movable along the first pin when the blocking portion is moved with more than a threshold amount of force.

18. The jumper assembly of claim 12, wherein the first pin is longer than the second pin and the blocking portion is located on the first pin such that the jumper shunt can be disconnected from the second pin while remaining in contact with the first pin.

19. The jumper assembly of claim 12, wherein the first pin is longer than the second pin, and wherein the jumper shunt is configured to be rotatable about the first pin when the jumper shunt is moved along the first pin beyond a length of the second pin.

20. The jumper assembly of claim 19, wherein the jumper shunt is configured to provide an electrical connection between the first pin and either the second pin or a third pin based on a rotational position of the jumper shunt about the first pin.

21. The jumper assembly of claim 19, wherein the blocking portion is positioned on the first pin so as to prevent the jumper shunt from being rotated over a third pin that is longer than the second pin but shorter than the first pin.

22. The jumper assembly of claim 12, wherein the first pin includes a surface discontinuity, and wherein the jumper shunt includes a clip configured to mate with the surface discontinuity to limit movement of the jumper shunt along the first pin.

23. The jumper assembly of claim 22, wherein the surface discontinuity is positioned on the first pin so as to prevent the jumper shunt from being rotated over a third pin that is longer than the second pin but shorter than the first pin.

24. The jumper assembly of claim 22, wherein the clip is configured to allow the clip to release from the surface discontinuity when the jumper shunt is pulled with more than a threshold amount of force.

25. The jumper assembly of claim 22, wherein the surface discontinuity includes an indentation or a protrusion on the first pin.

26. The jumper assembly of claim 22, wherein the jumper shunt further includes a housing, and at least a portion of the clip is located inside the housing.

27. The jumper assembly of claim 22, wherein the jumper shunt further includes a housing, and a release portion outside the housing that is configured to release the clip from the surface discontinuity when pressed.

* * * * *